United States Patent [19]

Sugimoto et al.

[11] Patent Number: 4,499,982

[45] Date of Patent: Feb. 19, 1985

[54] VEND POSSIBLE JUDGEMENT DEVICE FOR A VENDING MACHINE

[75] Inventors: Osamu Sugimoto; Masaki Akagawa, both of Sakado, Japan

[73] Assignee: Kabushiki Kaisha Nippon Coinco, Tokyo, Japan

[21] Appl. No.: 359,163

[22] Filed: Mar. 17, 1982

[30] Foreign Application Priority Data

Mar. 24, 1981 [JP] Japan ..... 56-41658

[51] Int. Cl.[3] ..... G07F 5/24

[52] U.S. Cl. ..... 194/1 N; 194/4 C

[58] Field of Search ..... 133/1 R, 2, 8 R; 194/2, 194/DIG. 14, 1 N, 1 M, 10, DIG. 3, 4 C

[56] References Cited

U.S. PATENT DOCUMENTS

| | | | |
|---|---|---|---|
| 3,190,426 | 6/1965 | Cahill et al. | 194/10 X |
| 3,963,035 | 6/1976 | Levasseur | 194/1 N X |
| 4,225,056 | 9/1980 | Flubacker | 221/2 |
| 4,354,613 | 10/1982 | Desai et al. | 221/4 |
| 4,376,478 | 3/1983 | Sugimoto et al. | 194/1 N |
| 4,381,835 | 5/1983 | Shah et al. | 194/1 N |

*Primary Examiner*—Stanley H. Tollberg
*Attorney, Agent, or Firm*—Spensley Horn Jubas & Lubitz

[57] ABSTRACT

A stored coin and bill number counter unit counts up the numbers of deposited coins and bills for respective denominations and counts down the numbers of paid out coins and bills for the respective denominations and thereby obtains the numbers of coins and bills for the respective denominations stored for paying out of change. A comparison and operation unit primarily judges whether vending is possible or not by comparing the amount of the deposited coins and bills with the set vend price and obtains the amount to be paid out as change by calculating difference between the deposited amount and the set vend price. A change payout permission judgement unit judges whether payout of the amount to be paid out as change is possible or not by utilizing the numbers of the coins and bills of the respective denominations calculated by the counter unit and, if such payout is possible, permits ultimately vending of an article corresponding to the set vend price on condition that the comparison unit has judged, with respect to the particular set vend price, that vending is possible. A shortage detection device may be provided in association with a change coin and bill storage device for detecting whether or not there is shortage of stored coins and bills of the respective denominations and the judgement unit may make the above described judgement on the basis of outputs of both the shortage detection device and the counter unit.

12 Claims, 3 Drawing Figures

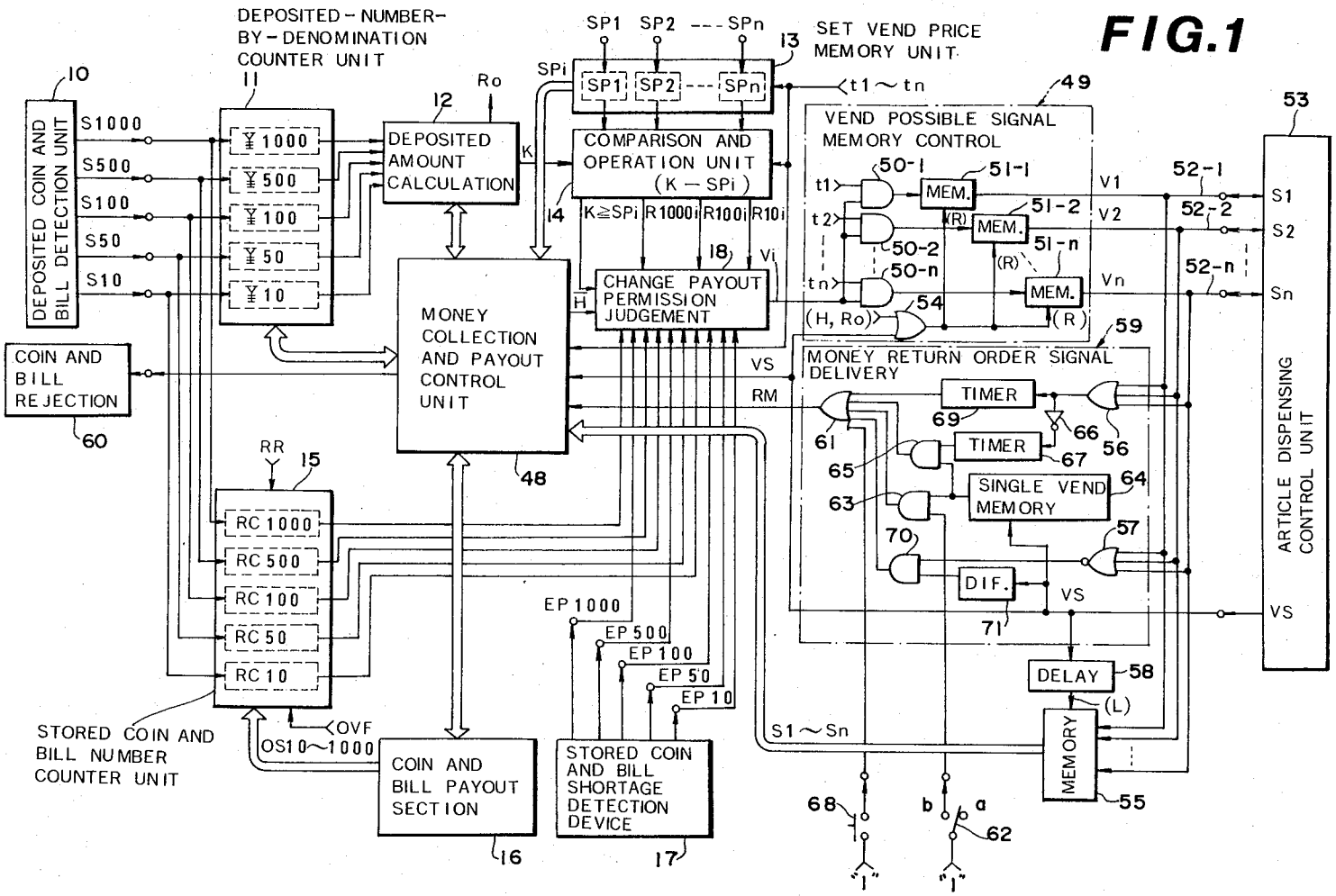
FIG.1
ARTICLE DISPENSING CONTROL UNIT
VEND POSSIBLE SIGNAL MEMORY CONTROL
MONEY RETURN ORDER SIGNAL DELIVERY
SET VEND PRICE MEMORY UNIT
COMPARISON AND OPERATION UNIT (K — SPi)
CHANGE PAYOUT PERMISSION JUDGEMENT
DEPOSITED AMOUNT CALCULATION
MONEY COLLECTION AND PAYOUT CONTROL UNIT
STORED COIN AND BILL SHORTAGE DETECTION DEVICE
COIN AND BILL PAYOUT SECTION
DEPOSITED-NUMBER-BY-DENOMINATION COUNTER UNIT
DEPOSITED COIN AND BILL DETECTION UNIT
COIN AND BILL REJECTION
STORED COIN AND BILL NUMBER COUNTER UNIT
SINGLE VEND MEMORY
TIMER
DIF.
DELAY
MEMORY
MEM.

VEND POSSIBLE JUDGEMENT DEVICE FOR A VENDING MACHINE

BACKGROUND OF THE INVENTION

This invention relates to a vend possible judgement device for a vending machine and, more particularly, to a device capable of performing judgement as to whether vending is possible or not by calculating an amount to be paid as change on the basis of an amount of deposited coins or bills and a set vend price and judging whether the change is payable or not on the basis of the amount to be paid as change and coins and bills stored for paying out of change.

A basic condition on which the vend possible judgement (i.e., judgement that an article is vendible) is made is that an amount of money (K) which is equal to or exceeding a set vend price (SPi) has been deposited, i.e., the condition $K \geqq SPi$ has been satisfied. Since, however, it is necessary to prohibit vending if paying out of change is not possible, it has been customary with prior art vending machines to restrict the condition on which the vend possible judgement is made if there is shortage in coins stored for paying out of change. In a case where coins of a large denomination stored for paying out of change are short but those of a small denomination are sufficient, change corresponding to the coin of the large denomination can be paid out in the coins of the small denomination and, accordingly, vending may be permitted in accordance with the above described basic vend possible condition. In a case, however, where coins of the small denomination stored for paying out of change are short, there is likelihood that paying out of change is not possible. For this reason, in such a case vending is generally permitted only if change is not required (i.e., the deposited amount K coincides with the set vend price SPi) and otherwise is prohibited even if the deposited amount K exceeds the set vend price SPi. If, accordingly, there is shortage in coins stored for paying out of change, particularly in coins of a small denomination, chances of vending will be missed with the result that the operation efficiency of the vending machine will be reduced.

For overcoming such problem, it has been conceived that vending may be permitted even in a case where paying out of change is required if storage of coins of a large denomination stored for paying out of change is sufficient and the change can be paid out in the large denomination coins even if coins of a small denomination are short. For this purpose, Japanese Patent Publication No. 41475/1980, for example, discloses an art according to which, in comparing the deposited amount K with the set vend price SPi, an amount of a predetermined large denomination coin (e.g. 50 yen) is previously added to the set vend price SPi, the result of addition is compared with the deposited amount and the vend possible judgement is made when they coincide with each other ($K = SPi + 50$). The coincidence of the sum of the set vend price and the amount of the large denomination coin with the deposited amount means that difference between the deposited amount and the set vend price, i.e., change, can be paid out in the large denomination coin.

For coping with the problem of shortage of coins and bills stored for paying out of change, Japanese Patent Publication No. 39159/1979 discloses another device according to which numbers of deposited coins for respective denominations are stored in a memory and, in case of shortage of change, vending is allowed only if the change can be paid out by using the coins of the same denomination as the one of the deposited coins. In other words, vending is allowed only if the coins which have just been deposited can be used for change of the vending.

In the prior art vend possible judgement methods as represented by the above described examples, the judgement of shortage of coins and bills stored for paying out of change is made on the basis of a maximum value of an amount of change which can be paid out in a single vending (i.e., whether the amount of coins and bills stored for paying out of change is larger or smaller than this maximum value) and, accordingly, the judgement that coins and bills stored for paying out of change are insufficient will be made despite that there is a small amount of coins or bills left for paying out of change resulting in the judgement that vending is impossible. In the former example of the prior art devices, for instance, if the number of coins and bills stored for paying out of change is below a predetermined number with respect to both a large denomination and a small denomination, the judgement of change shortage is made with the result that vending requiring payout of change is prohibited. However, there can be a case where required change can be paid out by the remaining small amount of coins depending upon the amount of deposited coins and in such case it is not desirable to make the judgement that vending is impossible. In the latter example of the prior art devices in which only the numbers of denominations of the deposited coins are considered, the judgement that change cannot be paid out will be made on the basis of the number of the deposited coins despite that there is a small amount of coins or bills left for paying out of change with the result that vending is prohibited. If, for example, there are two 10-yen coins stored for paying out of change, the set vend price is 80 yen and the deposited coin is a 100-yen coin, the judgement of change shortage will be made, for the maximum number of 10-yen change coins in the judgement of shortage of coins stored for paying out of change is normally set to be 9, and the judgement that payout of change is impossible will be made, for the deposited coin in this case is a single 100-yen coin. As a result, vending is not permitted. Further, it is not usual that a part of deposited coins is directly returned as change (because minimum possible coins are usually deposited) and, accordingly, probability of enlarging sales chances by such method is not very high.

SUMMARY OF THE INVENTION

It is an object of the invention to provide a vend possible judgement device for a vending machine capable of effectively performing the vend possible judgement and thereby preventing missing of sales chances to a maximum degree in a case where coins and bills stored for paying out of change are reduced to a small number.

It is another object of the invention to provide a vend possible judgement device suitable for use in a vending machine of a type which handles relatively many kinds of coins and bills stored for paying out of change and is capable of paying out change of a relatively high amount, in view of recent increase in variety of set vend prices and usable coins and bills and accompanying increase in variety of coins and bills stored for paying out of change.

These objects can be achieved by providing a vend possible judgement device for a vending machine comprising comparison means for primarily judging whether vending is possible or not by comparing an amount of deposited coins and bills with a set vend price; operation means for obtaining an amount to be paid out as change by calculating difference between said amount of deposited coins and bills and said set vend price; stored number counter means for obtaining numbers of coins and bills stored for paying out of change for respective denominations by counting up and down deposited coins or bills and paid out coins or bills for respective denominations; and change payout permission judgement means for judging whether said amount to be paid out as change can be paid out or not by using the numbers of stored coins and bills for the respective denominations obtained by said counter means; vending of an article corresponding to said set vend price being ultimately permitted on condition that a vend possible judgement has been made by said comparison means with respect to said set vend price when said amount to be paid out as change has been judged payable by said change payout permission judgement means.

Even if the number of coins and bills stored for paying out of change is reduced to a number below the basic number for detecting shortage of change which has been used in the prior art devices, the number of stored coins and bills can be obtained by the counter means so that the judgement of vend impossible is not unconditionally made but vending is permitted if change can be paid out by the remaining number of coins and bills. According to the invention, therefore, sales chances can be enlarged compared with the prior art devices.

In a preferred embodiment of the invention, whether change can be paid out or not is judged for each digit of the amount to be paid out as change and vending is permitted if change is payable with respect to all of the digits. This is because the judgement as to payout of change can be made most accurately if it is made for each of the digits on the basis of presence or absence of coins and bills stored for paying out of change of the denomination corresponding to the digit. The invention, however, is not limited to this. For example, payout of change is possible if there is a sufficient number of coins of a small denomination despite shortage of coins of a large denomination.

In the preferred embodiment, whether the amount to be paid out as change can be paid out or not is judged by using not only the numbers of stored coins and bills for the respective denominations calculated by said counter means but also the prior art stored coin shortage detection means based on a predetermined number of coins. This increases reliability of the judgement.

It is still another object of the invention to provide a vend possible device capable of a continuous vending control in relation to the judgement as to whether payout of the amount to be paid out as change is possible or not. The amount to be paid out as change is calculated in respect of each of a plurality of set vend prices and, on the basis of the calculated amount, vend possible judgement is made with respect to each of the set vend prices. The device performs a control operation so that balance of the amount of deposited coins and bills is automatically paid out as change when the judgement is made that vending of an article is not permitted with respect to any of the set vend prices after at least a single vending has been made. Accordingly, continuous vending is possible in the vend possible judgement in which the amount to be paid out as change is taken into account so long as vending is permitted, and the change is automatically paid out and the continuous vending is terminated when vending is not permitted.

In embodiments to be described below, description is made with respect to a vending machine used for Japanese currency (yen). It should be noted that the invention is applicable to a vending machine in which other currency is used. For example, 10-yen coin, 50-yen coin, 100-yen coin, 500-yen coin and 1000-yen bill used in the following embodiment may be respectively replaced by 5-cent coin, 10-cent coin, 25-cent coin, 50-cent coin and 1-dollar note if the vending machine is used for the U.S. currency and by 1-penny coin, 5-pence coin, 10-pence coin, 50-pence coin and 1-pound note respectively if the vending machine is used for the British currency.

BRIEF DESCRIPTION OF THE DRAWINGS

In the accompanying drawings:

FIG. 1 is a block diagram showing an example of an entire control system of the vending machine incorporating the device according to the invention;

DESCRIPTION OF PREFERRED EMBODIMENTS

Figure 2:
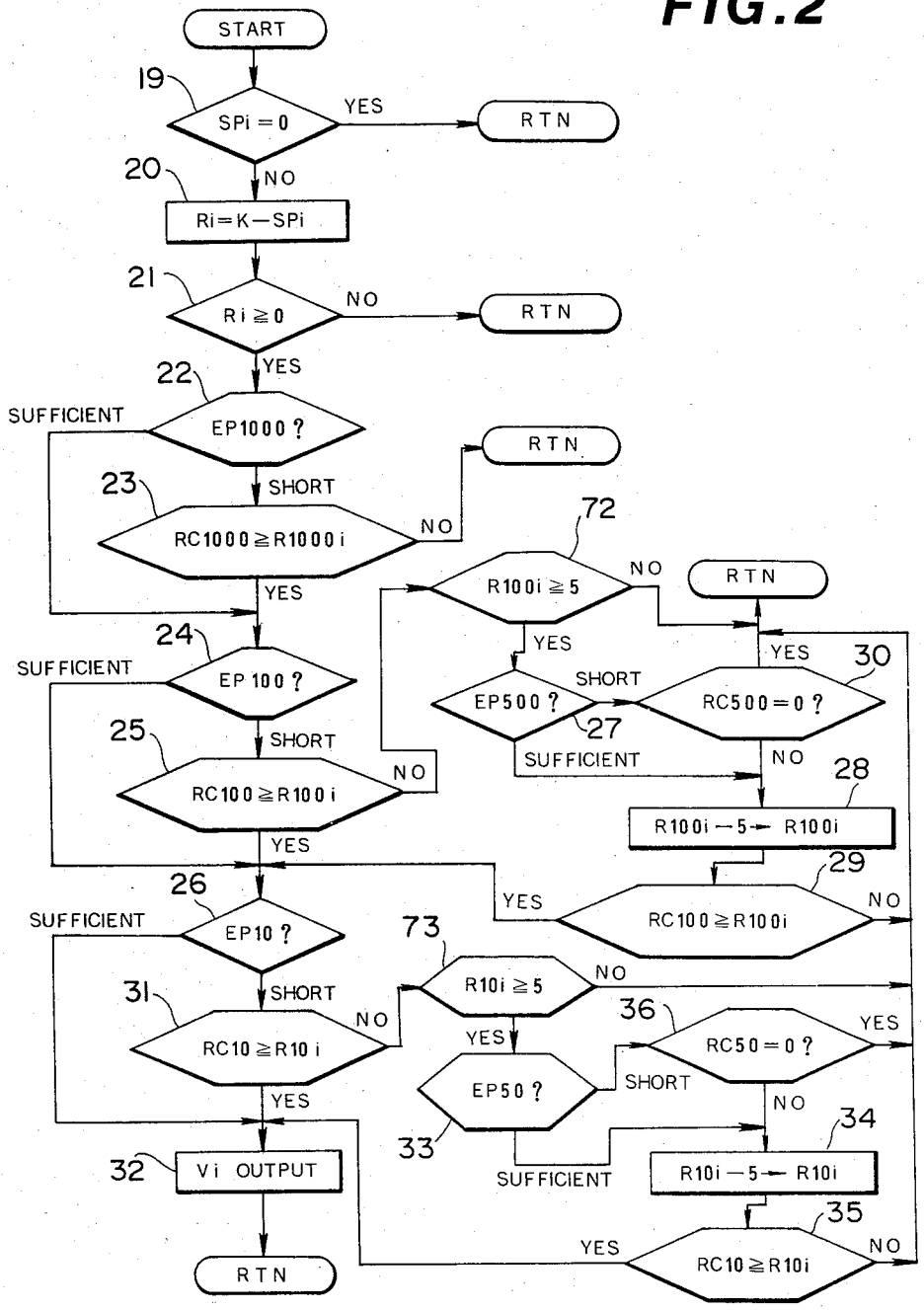
FIG. 2 is a flow chart showing an embodiment of the vend possible judgement device according to the invention in which processings in the comparison and operation unit and the change payout permission judgement unit in FIG. 1 are illustrated.

Referring first to FIG. 1, a deposited coin and bill detection unit 10 is provided for detecting coins and bills which have been deposited in the vending machine and producing deposited coin and bill detection signals S1000, S500, S100, S50 and S10 in accordance with the denominations of the detected coins. By way of example, the detection signal S1000 corresponds to a 1000-yen bill, S500 a 500-yen coin (or 500-yen bill), S100 a 100-yen coin, S50 a 50-yen coin and S10 a 10-yen coin, respectively. A deposited-number-by-denomination counter unit 11 counts the numbers of the deposited coins and bills by denominations in response to the deposited coin and bill detection signals S1000–S10. A deposited amount calculation unit 12 sums up contents of the deposited-number-by-denomination counter unit 11 to obtain a total amount K of the deposited coins and bills. This total amount K decrease each time a money collection control or a change payout control is effected, thus representing substantially the balance of the amount of the deposited coins and bills (before vending, the total amount of the deposited coins and bills being equal to the balance).

A set vend price memory unit 13 includes memories which respectively store set vend prices SP1–SPn for respective articles provided by operation of vend price setting switches (not shown). When, for example, the amount K of the deposited coins is 0, i.e., in a stand-by mode, the set vend prices SP1–SPn are loaded in the memory section 13. A comparison and operation unit 14 compares data representing the amount K provided by the deposited amount calculation unit 12 with the respective set vend prices SP1–SPn provided by the set vend price memory unit 13 to judge, with respect to each of the set vend prices SP1–SPn, whether the condition K≧SPi (where i=1, 2, . . . n) is satisfied or not and also performs calculation "K−SPi=Ri" to obtain difference between the amount K and the set vend price SPi, i.e., an amount Ri to be paid out as change, outputting data representing this amount Ri with respect to each decimal digit (i.e., R1000*i*, R100*i* and R10*i*). The satisfaction of the condition "K≧SPi" means that the amount K which is equal to or exceeding the set vend price SPi has been deposited and, accordingly, an article corresponding to the set vend price SPi can be vended if coins stored for paying out of change are not short. The amount Ri to be paid out as change does not mean change which is actually to be paid out but change which is required if the article corresponding to the set vend price SPi is assumed to be vended. R1000*i* represents a value of a thousands digit in the amount Ri, R100*i* that of a hundreds digit and R10*i* that of a tens digit, respectively.

The comparison K≧SPi and the operation K−SPi=Ri are performed on a time shared basis for each set vend price SPi in accordance with time division timing pulses t1–tn. For this purpose, the time division timing pulses t1–tn are applied to the set vend price memory unit 13 and the comparison and operation unit 14 so that data representing the set vend prices SP1–SPn stored in the memory 13 are read out on a time shared basis in accordance with the pulses t1–tn and applied to the comparison and operation unit.

A stored coin and bill number counter unit 15 counts, by denominations, the numbers of coins and bills held in the vending machine for paying out of change. RC1000 represents the number of 1000-yen bills, RC500 that of 500-yen coins, RC100 that of 100-yen coins, RC50 that of 50-yen coins and RC10 that of 10-yen coins, respectively held in the vending machine for paying out of change. A change coin storage unit (not shown) is provided for each denomination and deposited coins are automatically supplied to storage units corresponding to the denomination of the deposited coins whereas coins to be paid out of the vending machine as change or money to be returned to the customer are paid out of the storage unit corresponding to the coins. The stored coin and bill number counter unit 15 counts up the numbers of coins and bills supplied to the change coin storage units and counts down the number of coins and bills paid out of these storage units and thereby obtains numbers RC1000–RC10 of coins and bills presently stored in the storage unit. In other words, the counter unit 15 counts up the numbers of deposited coins for the respective denominations in response to deposited coin and bill detection signals S1000–S10 for the respective denominations and counts down the numbers of paid out coins in response to coin payout confirmation signals OS10–OS1000 provided by a coin payout section 16.

Once the change coin storage unit has been filled with coins, coins deposited in the vending machine overflow from the storage unit and are received in a cash box (not shown). For this purpose, when the change coin storage unit has been filled with coins, an overflow signal OVF corresponding to the denomination of the coins is produced and supplied to the counter unit 15. In the counter unit 15, counting up of the number of coins corresponding to the denomination for which the overflow signal OVF has been produced is prohibited so that the number of deposited coins which have not been supplied to the storage unit will not be counted. Prohibition of counting up during presence of the overflow signal OVF is effected in suitable manners such as inhibiting the deposited coin detection signal (one of S1000–S10) corresponding to the denomination for which the overflow signal OVF has been produced for preventing carrying out of the addition or making addition but substantially inhibiting the addition by subtracting coins which have overflown and have been directed to the cash box.

The change coin storage unit can be constructed of a casette type device which is detachable from the changer structure of the vending machine. Such casette type coin storage unit is convenient in that it is detached as a whole from the changer device in collecting money from the vending machine so that stored coins can be taken out in a single operation. After transferring the stored coins, the empty storage unit is mounted to the changer device again. Since transferring of coins at this time is not caused by the operation of the coin and bill payout section 16, no subtraction is made at this time in the stored coin and bill number counter unit 15. Accordingly, the counter unit 15 displays a value as if coins were stored in the storage unit despite the fact that the storage unit is empty. For eliminating such inconvenience, an arrangement is made so that a reset signal RR is produced when the casette type change coin storage unit is detached from the changer device and the entire contents RC1000–RC10 in the counter unit 15 are reset by this reset signal RR.

In a case where the casette type storage unit is detached from the changer device but is mounted to the changer device without transferring coins stored therein at all or after manually supplying some coins after transferring the stored coins, resetting of the counter unit 15 will cause inconvenience rather than eliminate it. For coping with such situation, resetting (or presetting) may be controlled by utilizing outputs EP1000–EP10 of a stored coin and bill shortage detection unit 17 to be described later. If, for example, the detached casette type storage unit is always mounted to the changer device after adjusting the number of coins stored therein to a predetermined number, the counter unit 15 may be initially set to said predetermined number by the reset signal RR which is produced at the time of detaching the storage unit.

As described above, there is possibility that supply or transferring of coins in the change coin storage unit is made manually. It is desirable in this case that inputting and outputting of coins be accurately reflected in the stored coin and bill number counter unit 15. If not, however, the invention can still be implemented without inconvenience. Even if the counter unit 15 counts up and down deposited coins and paid out coins only, increase and decrease of the number of change coins held in the vending machine can be detected without substantial inconvenience, for inputting and outputting of coins in the vending machine are caused mostly by such deposited and paid out coins.

The stored coin and bill shortage detection unit 17 is a device which is known per se as an "empty sensor" which is provided in a position of the predetermined number of coins in each of the change coin storage units for the respective denominations. The position of the predetermined number of coins at which the empty sensor is disposed generally means a position corresponding to the largest number at which the coins of the denomination are paid out at a time as change or a number which is larger by several coins than said largest number. As to stored coin and bill shortage detection signals EP1000–EP10 outputted by the detection unit 17, EP1000 corresponds to the 1000-yen bill, EP500 the 500-yen coin, EP100 the 100-yen coin, EP50 the 50-yen coin and EP10 the 10-yen coin, respectively. If the number of the stored change coins of a certain denomination is larger than the predetermined number, the shortage detection signals EP1000–EP10 indicate "change is sufficient" (e.g., "1") whereas if the number is smaller than the predetermined number, they indicate "Change is short" (e.g. "0").

Since the numbers of coins RC1000–RC10 for the respective denominations are counted by the stored coin and bill number counter unit 15, there is some overlapping in functions between the stored coin and bill shortage detection unit 17 and the counter unit 15. The presence of the stored coin and bill shortage detection unit 17, however, serves for confirmation of reliability of the counter unit 15, for contents of the counter unit 15 can be unreliable when supply or transferring of coins is made manually in the change coin storage unit. On the other hand, even if shortage of change coins has been detected by the stored coin and bill detection unit 17, there is possibility that a small number of coins are still stored in the change coin storage unit. In such a case, existence of the stored coins can be confirmed by the counter unit 15. By utilizing both the stored coin and bill number counter unit 15 and the stored coin and bill shortage detection unit 17, detection of the change coin number can be effectively carried out through the complementary operation between the two units.

A change payout permission judgement unit 18 judges whether the amount Ri to be paid out as change can be paid out by change coins held presently on the basis of the result of comparison K≧SPi and data R1000*i*, R100*i* and R10*i* of respective digits of the amount Ri to be paid out as change provided by the comparison and operation unit 14, change coin number data RC1000–RC10 for the respective denominations provided by the stored coin and bill number counter unit 15 and the stored coin and bill shortage detection signals EP1000–EP10 for the respective denominations provided by the stored coin and bill shortage detection unit 17. If payout of the change is possible (including the case where Ri=0), the judgement unit 14 outputs a vend possible signal Vi on condition that K≧SPi is satisfied. The judgement as to whether change coin can be paid out or not is carried out by comparing the respective digits R1000*i*, R100*i* and R10*i* with the change coin numbers RC1000–RC10 for the respective denominations corresponding to these digits.

FIG. 2 is a flow chart showing the process of the vend possible judgement implemented in the comparison and operation unit 14 and the change payout permission judgement unit 18. It is at the time of "money deposited", i.e., the amount K of the deposited coins and bills is any value other than 0, that the vend possible judgement program starts. In Step 19, whether the set vend price SPi is 0 or not is judged. When the set vend price SPi is 0, the vend possible judgement is meaningless and, accordingly, the program returns to the start (RTN). When the set vend price SPi is not 0, the program proceeds to Step 20 through the route NO in Step 19. In Step 20, subtraction "Ri=K−SPi" is conducted to obtain difference between the amount K of the deposited coins and the set vend price SPi, i.e., the amount Ri to be paid out as change. In Step 21, whether the difference Ri is equal to or larger than 0 is judged. The judgement as to whether the condition "Ri≧0" is satisfied or not is equivalent to the judgement as to whether the condition "K≧SPi" is satisfied or not. If the judgement in Step 21 is NO, it means that the amount K of the deposited coins is smaller than the set vend price SPi and, since vending is not possible in this case, the program returns to the start (RTN). If the judgement in Step 21 is YES, it means that the amount K is equal to the set vend price SPi (i.e., Ri=0) or that the amount K is larger than the set vend price SPi (i.e., R>0) and the process of Step 22 and subsequent steps is carried out for judgement as to whether payout of change is permitted or not. The process in Steps 19, 20 and 21 corresponds to the process in the comparison and operation unit 14 in FIG. 1 and the process in Step 22 and the subsequent Steps corresponds to the process in the change coin payout permission judgement unit 18.

In Step 22, whether change of the 1000-yen bill is short or not is judged on the basis of the stored coin and bill shortage detection signal EP1000 of the 1000-yen bill. If there is shortage, the change coin number RC1000 for the 1000-yen bill is compared with R1000*i* which is the thousands digit of the amount Ri to be paid out as change for judgement as to whether the condition "RC1000≧R1000*i*" is satisfied or not. If EP1000 indicates "change sufficient", the program jumps over Step 23 and performs Step 24. If Step 23 is NO, change R1000*i* of the thousands digit cannot be paid out and, accordingly, the judgement that vending should not be permitted is made and the program returns to the start (RTN). If Step 23 is YES, it means that there is a sufficient number RC1000 for paying out change R1000*i* of the thousands digit even if the change coin shortage detection unit 17 has detected shortage of change in the 1000-yen bill. Accordingly, the judgement is made that the change R1000*i* of the thousands digit can be paid out and the program proceeds to Step 24. When the signal EP1000 indicates "change sufficient", it means that the number of the stored 1000-yen bill is equal to or larger than the largest number payable at a time so that the change R1000*i* of the thousands digit can of course be paid out.

In Step 24, whether the 100-yen change coins is short or not is judged on the basis of the stored coin and bill shortage detection signal EP100 for the 100-yen coin. If there is shortage, the change coin number RC100 for the 100-yen coin is compared with the hundreds digit R100*i* of the amount Ri to be paid out as change in Step 25 for judgement as to whether the condition "RC100≧R100*i*" is satisfied or not. If the judgement is YES, it means that there is a sufficient number RC100 of the 100-yen coin for paying out the change R100*i* of the hundreds digit even if shortage of the 100-yen change coins has been detected. Accordingly, judgement is made that the change R100*i* of the hundreds digit is payable and the program proceeds to Step 26. On the other hand, if the signal EP100 indicates "change sufficient", the program jumps over Step 25 and proceeds to Step 26. If the signal EP100 indicates "change sufficient", it means that the number of the stored 100-yen coins is equal to or larger than the largest number of coins payable at a time and, accordingly, the change R100*i* of the hundreds digit can of course be paid out.

When Step 25 is NO, it means that the hundreds digit change R100*i* is larger than the number RC100 of the 100-yen coins. In this case, whether the hundreds digit change R100*i* can be paid out by the 500-yen coins or not is judged. In Step 72, whether or not R100*i* is 5 or a larger number is first judged. If the result of this judgement is NO, the program returns to the start (RTN) whereas if the result is YES, the program proceeds to Step 27. In Step 27, whether the 500-yen change coins are short or not is judged on the basis of the 500-yen stored coin shortage detection signal EP500. If the result of the judgement is "change sufficient", the program proceeds to Step 28 in which 5 is subtracted from the hundreds digit R100*i* of change Ri and the difference is substituted by R100*i*. Accordingly, R100*i* obtained in Step 28 represents the number of the 100-yen change coins in the case of paying out the change R100*i* of the hundreds digit by combination of the 500-yen coins and the 100-yen coins. In next Step 29, a similar judgement as in Step 25 (i.e., whether RC100≧R1000*i* is satisfied or not) is carried out. In this case, however, R100*i* is a value which is smaller by 5 than the value in Step 25 as a result of the subtraction in Step 28. Accordingly, even if "RC100≧R100*i*" was not satisfied in Step 25, the same condition can be satisfied in Step 29. If Step 29 is YES, it means that the hundreds digit change R100*i* can be paid out by combination of the 500-yen coins and the 100-yen coins and the program proceeds to Step 26. If Step 29 is NO, it means that the hundreds digit change R100*i* cannot be paid out either by the 100-yen coins alone or by the combination of the 500-yen coins and the 100-yen coins. In this case, the program returns to the start (RTN).

If it is judged in Step 27 that the 500-yen change coins are short, the program proceeds to Step 30 in which judgement is made as to whether the number RC500 of the stored 500-yen coins in the counter unit 15 is 0 or not. If "RC500=0" is YES, it means that the hundreds digit change R100*i* cannot be paid out by the 500-yen coins (nor by the 100-yen coins) and the program returns to the start (RTN). If "RC500=0" is NO, the program proceeds to Step 28 and further Step 29 is carried out in the same manner as was previously described.

In Step 26, judgement is made as to whether the 10-yen change coins are short or not on the basis of the 10-yen change coin shortage detection signal EP10. If there is shortage, the number RC10 of the 10-yen change coins is compared with the tens digit R10*i* of the change Ri in Step 31 for judgement as to whether "RC≧R10*i*" is satisfied or not. If the result of the judgement is YES, it means that there is a sufficient number RC10 for paying out the tens digit change R10*i* even if shortage of the 10-yen change coins has been detected. It is therefore judged that the tens digit change R10*i* is also payable and the program proceeds to Step 32. If EP10 indicates "change sufficient", it means that the number of the stored 10-yen coins is equal to or larger than the largest number of coins payable at a time so that the tens digit change coins R10*i* is of course payable. In this case, the program proceeds to Step 32 jumping over Step 31.

If Step 31 is NO, it means that the tens digit change R10*i* is larger than the nunber RC10 of the stored 10-yen coins. In this case, judgement is made as to whether the change R10*i* can be paid out by the 50-yen coins or not. In Step 73, whether or not R10*i* is 5 or a larger number is first judged. If the judgement is NO, the program returns to the start (RTN) whereas if the judgement is YES, the program proceeds to Step 33. Nextly, in Step 33, judgement is made as to whether the 50-yen change coin is short or not on the basis of the 50-yen stored coin shortage detection signal EP50. If the judgement is "change sufficient", the program proceeds to Step 34 in which 5 is subtracted from R10*i* and R10*i* is substituted by the result of the subtraction. In next step, Step 35, judgement similar to that in Step 31, i.e., "RC10≧R10*i*" is carried out. R10*i* in Step 35 is a value which is smaller by 5 than R10*i* in Step 31. If the 50-yen change coin is short, the program proceeds from Step 33 to Step 36 in which judgement is made as to whether the stored 50-yen coin number RC50 is 0 or not. When the number RC is 0, it means that the change R10*i* of the tens digit cannot be paid out by the 50-yen coins (nor by the 10-yen coins) and, accordingly, the program returns to the start (RTN).

When "RC50=0" is NO, Steps 34 and 35 are implemented. If, accordingly, the change R10*i* of the tens digits can be paid out by combination of 50-yen coins and 10-yen coins, the program proceeds to Step 32 through the route YES in Step 35.

In Step 32, the vend possible signal Vi is outputted and thereafter the program returns to the start (RTN). As described above, difference between the amount K of deposited coins and the set vend price SPi, i.e., the amounts R1000*i*, R100*i* and R10*i* of the respective digits of the change Ri, are respectively compared with the stored coin numbers RC1000–RC10 and the judgement of "vend possible" is made when changes of all digits are payable. In a case where payment of change is not required, i.e., Ri=0, Steps 23, 25 and 31 necessarily become YES so that the vend possible signal Vi is produced even when the stored coin numbers RC1000–RC10 are all 0.

By way of example, explanation is made about the vend possible judgement when the amount K is 500 yen and the set vend price SPi is 200 yen and 80 yen on the assumption that the 100-yen stored coin number RC100 is "5" and the 10-yen stored coin number RC10 is "1". In case of SPi=200, the amount Ri to be paid out as change is Ri=300, the thousands digit R1000*i* being R1000*i*=0, the hundreds digit R100*i* being R100*i*=3, and the tens digit R10*i* being R10*i*=0, respectively. Accordingly, Steps 23, 25 and 31 are all YES and the vend possible signal Vi is generated. In case of SPi=80, the respective digits are Ri=420, R1000*i*=0, R100*i*=4 and R10*i*=2. In this case, Steps 23 and 25 are YES but Step 31 is NO and Step 35 is also NO so that judgement that vending is not possible is made (EP10 is assumed to be indicating shortness).

If the number of the stored coins of the same digit is short, the judgement may be made upon substituting this number by the number of the stored coins of a less significant digit. If, for example, 10 RC10 coins are substituted for RC100 in the judgement of R100*i*, judgement of R10*i* must be made after excluding 10 coins from RC10.

Figure 3:
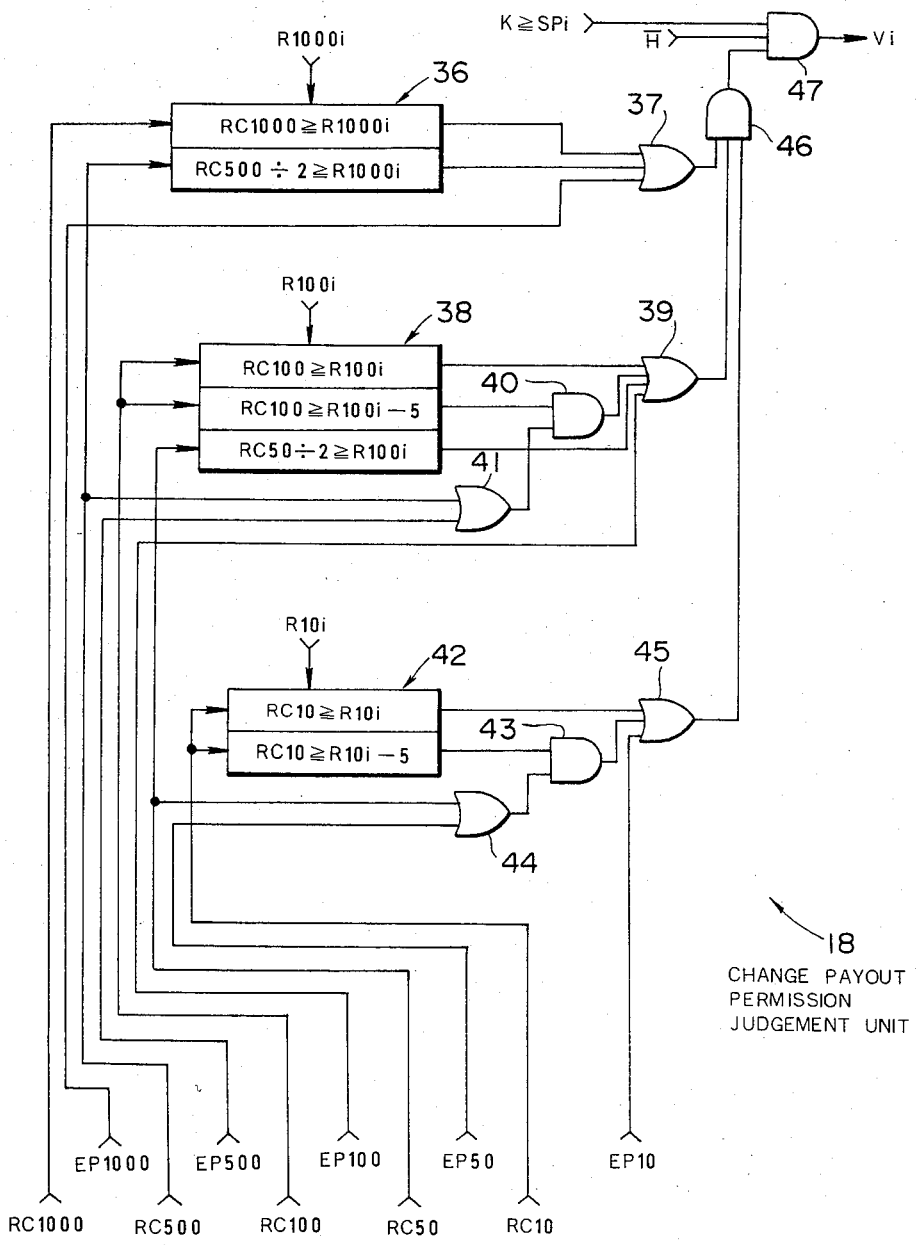
FIG. 3 is a block diagram of another embodiment of the invention showing the internal construction of the change payout permission judgement unit in FIG. 1.

FIG. 3 shows an example of constituting the change payout permission judgement unit 18 by a discrete circuit which performs a similar function to the process after Step 22 in FIG. 2. A comparison unit 36 conducts comparison concerning the thousands digit R1000*i* of the amount Ri to be paid out as change in two comparisons of "RC1000≧R1000*i*" and "RC500÷2≧R1000*i*". Results of respective comparisons are applied to an OR gate 37. To another input terminal of the OR gate 37 is applied the shortage detection signal EP1000 for the 1000-yen change coin. "RC1000≧R1000" is comparison similar to the comparison in Step 23 in FIG. 2 according to which "1" is outputted when the stored 1000-yen coin number RC1000 is equal to or larger than R1000*i*. In "RC500÷2≧R1000*i*", the stored 500-yen coin number RC500 is divided by 2 and is substituted for the number of the 1000-yen bill and thereafter is compared to find whether this is equal to or larger than R1000*i*. If the change R1000*i* of the thousands digit can be paid by 500-yen coins, the comparison output is "1". Further, if the 1000-yen bill stored for change apparently is not short, the signal EP1000 is "1". Accodingly, when the change R1000*i* of the thousands digit is payable, any input signal to OR gate 37 is "1" and an output thereof is "1".

A comparison unti 38 conducts comparison concerning the hundreds digit R100*i* of the amount Ri to be paid out as change in three ways as described below. "RC100≧R100*i*" is comparison similar to the comparison in Step 25 in FIG. 2 and "1" is outputted and applied to an OR gate 39 when the 100-yen stored coin number RC100 is equal to or larger than R100*i*.

"RC100≧R100*i*−5" is the same as the process in Steps 28 and 29 in FIG. 2, i.e., "5" is subtracted from R100*i* and the number of the 100-yen coins stored for change in the case of paying out R100*i* by combination of 500-yen coins and 100-yen coins is calculated to compare whether this number is more than 0 and below the 100-yen stored coin number RC100. If this condition of comparison is satisfied, a signal "1" is applied to and AND gate 40. The AND gate 40 receives, at other input thereof, the 500-yen change coin shortage detection signal EP500 and a signal representing the 500-yen stored coin number RC500 through an OR gate 41. When RC500 is not 0 or EP500 is "1", i.e., there are any 500-yen coins as coins stored for paying out of change, the output of the OR gate 41 is "1" and the AND gate 40 therefore is enabled. Accordingly, when R100*i* of the hyndreds digit can be paid out by combination of 500-yen coins and 100-yen coins or by 500-yen coins alone (R100*i*−5=0), the output of the AND gate 40 is turned to "1" and this output is applied to the OR gate 39. "RC50÷2≧R100*i*" is comparison in which the 50-yen stored coin number RC50 is divided by 2 and substituted for the number of the 100-yen coins and comparison is made as to whether this is equal to or larger than R100*i*. If the change R100*i* of the hundreds digit can be paid by 50-yens coins, the comparison output is "1" which is applied to the OR gate 39. To another input of the OR gate 39 is applied to the 100-yen change coin shortage detection signal EP100. According to the above construction, when the change R100*i* of the hundreds digit R100*i* is payable, any input signal to the OR gate 39 is "1" and an output thereof is "1".

A comparison unit 42 conducts comparison concerning the tens digit R10*i* in the following two ways. "RC10≧R10*i*" is the same as the comparison in Step 31 in FIG. 2, i.e., a signal "1" is outputted and applied to an OR gate 45 when the 10-yen stored coin number RC10 is equal to or larger than R10*i*. "RC10≧R10*i*−5" is the same as the process in Steps 34 and 35, i.e., the number of the 10-yen stored coins in a case where "5" is subtracted from R10*i* and R10*i* is paid out by combination of 50yen coins and 10-yen coins is calculated and comparison is made as to whether this number is more than 0 and below the 10-yen stored coin number RC10 or not. If this comparison condition is satisfied, a signal "1" is applied to the AND gate 43. The AND gate 43 receives, in other inputs thereof, the 50-yen coin shortage detection signal EP50 and a signal representing the 50-yen stored coin number RC50 through an OR gate 44. When RC50 is not 0 or EP50 is "1", i.e., there are any 50-yen change coins, the output of the OR gate 44 is turned to "1" and the AND gate 43 thereby is enabled. Accordingly, when R10*i* can be paid out by combination of the 50-yen coins and 10-yen coins (or by 50-yen coins alone), the output of the AND gate 43 is turned to "1" and applied to the OR gate 45. To another input of the OR gate 45 is applied the 10-yen change coin shortage detection signal EP10. By the above described construction, when the tens digit change R10*i* is payable, any input signal to the OR gate 45 is "1" and the output thereof is "1".

Outputs of the OR gates 37, 39 and 45 are applied to AND gate 46. The output of the AND gate 46 is applied to an AND gate 47. The AND gate 46 receives, at the other inputs thereof, the comparison output of "K≧SPi" from the comparison and operation unit 14 (FIG. 1) and a signal $\overline{H}$ from the money collection and payout control unit 48 (FIG. 1). This signal $\overline{H}$ is a signal which is normally "1" and becomes "0" when the money collection and payout control unit 48 is performing its control operation or otherwise the vend possible judgement is undesirable as will be described later. When the amount K of the deposited coins is equal to or larger than the set vend price SPi and therefore the comparison output of "K≧SPi" is "1", and when the respective digits R1000*i*, R100*i* and R10*i* of the amount Ri to be paid out as change are payable, the output of the AND gate 46 is turned to "1" and the AND gate 47 thereby is enabled. The output of the AND gate 47 is outputted from the judgement unit 18 as the vend possible signal Vi. The vend possible signal Vi represents a vend possible state when it is "1" and a vend impossible state when it is "0". Since, in the present embodiment, the vend possible judgement is conducted on a time shared basis with respect to each of the set vend prices SPl–SPn, the signal Vi changes in accordance with changes in the signals SPi and R1000*i*, R100*i* and R10*i* in response to the time division timing.

In FIG. 1, the vend possible signal Vi for the respective prices outputted in time division from the change payout permission judgement unit 18 is applied to a vend possible signal memory unit 49. In this memory unit 49, the signal Vi is applied commonly to AND gates 50-1 through 50-n. The AND gates 50-1 through 50-n respectively receive, at other inputs thereof, time division timing pulses tl–tn. The outputs of the AND gates 50-1 through 50-n are applied to memory circuits 51-1 through 51-n. Accordingly, time division multiplexed vend possible signals Vi for the respective prices are demultiplexed in the AND gates 50-1 through 50-n and stored separately in the memory circuits 51-1 through 51-n.

Respective vend possible signal Vl–Vn stored in the memory circuits 50-1 through 50-n is supplied to an article dispensing control unit 53 through lines 52-1 through 52-n. The article dispensing control unit 53 performs vend possible indication for an article for which the vend possible signal Vl–Vn has been generated (i.e., the vend possible signal has been turned to "1"). When the customer operates a selection switch (not shown) for a desired article upon confirming the vend possible indication, the article dispensing control unit 53 starts the article dispensing operation on condition that the vend possible signal Vl–Vn has been generated for the selected article. Simultaneously, the article dispensing control unit 53 provides an article selection signal Sl–Sn representing the selected article (i.e., one of the signals Sl–Sn is turned "1") on one of lines 52-1 through 52-n and also outputs a vend start signal VS. This vend start signal VS is "1" when the article dispensing control unit 53 is performing the article dispensing operation (e.g., driving an article dispensing motor) and is "0" in other conditions.

The vend start signal VS is applied to reset terminals R of the memory circuits 51-1 through 51-n via an OR gate 54 in the vend possible signal memory control unit 49. The memory circuits 51-1 through 51-n are reset upon generation of the vend start signal VS and all of the vend possible signals Vl–Vn are cancelled. The signals on the lines 52-1 through 52-n are applied to a memory circuit 55 and also to an OR gate 56 and a NOR gate 57. A delay circuit 58 delays the vend start signal VS for a short period of time and thereafter supplies it to a load control terminal L of the memory circuit 55. Accordingly, the memory circuit 55 enters a loading mode immediately upon resetting of the memory circuits 51-1 through 51-n, storing signals on the lines 52-1 through 52-n. Since the article selection signal Sl–Sn from the article dispensing control unit 53 only is provided at this time on the lines 52-1 through 52-n, the memory circuit 55 stores the article selection signal Sl–Sn.

Time during which the article selection signal Sl–Sn is outputted from the article dispensing control unit 53 is a constant time in the order of 300 ms to 500 ms. Upon lapse of this time, the signal Sl–Sn falls to "0". In the control unit 53, comparison of the vend possible signal Vl–Vn and the article selection switch output is made by means of a relay or other switching circuit in a known manner and the article dispensing operation is made with the relay or other switching circuit being kept in a holding state and the article selection signal Sl–Sn is outputted on condition that the vend possible signal Vl–Vn has been generated for the article for which the selection switch has been operated.

The article selection signal Sl–Sn stored in the memory circuit 55 is supplied to the money collection and payout control unit 48. The money collection and payout control unit 48 implements chiefly (a) a control for subtracting the set vend price SPi (one of SPl–SPn) of the vended article from the amount K of the deposited coins (hereinafter referred to as "collection control"), (b) a change payout control, (c) a money return control (a control for returning the amount K), (d) a money deposition rejection control and (e) other controls (e.g., an inventory control or a deposition number restriction control). The construction of the control unit 48 is known and so detailed description thereof will be omitted.

The collection control is carried out upon receiving of the vend start signal VS. Data of the respective set vend prices SPi read out on a time shared basis from the set vend price memory unit 13 is demultiplexed into respective prices SPl–SPn by the time division timing pulses tl–tn and a single set vend price SPi (one of SPl–SPn) corresponding to the article selection signal Sl–Sn stored in the memory circuit 55 is selected from the demultiplexed signals and memorized. Thus, the set vend price SPi of the article which has just been vended is selected and is subtracted from the amount K of the deposited coins. This subtraction may be conducted in any desired manner. For example, value corresponding to the set vend price SPi may be subtracted from counts of the deposited-number-by-denomination counter unit 11 or the price SPi may be subtracted from the amount K held in the deposited amount calculation unit 12 while resetting the contents of the counter unit 11. The subtraction from the contents of the deposited-amount-by-denomination counter unit 11 may be performed in a suitable manner such, for example, as subtracting the value corresponding to SPi from the number of deposited coins or bills of a large denomination or, alternatively, subtracting the value from the number of deposited coins of a smaller denomination and, if subtraction becomes impossible, substituting the deposited number of the larger denomination for the smaller denomination. Whatever the manner of the money collection (i.e., manner of subtraction) may be, the amount K of the deposited coins in the deposited amount calculation unit 12 becomes a value obtained by subtracting the set vend price SPi from the initial deposited amount, i.e., balance of the deposited amount, upon completion of the collection control.

The change payout control or the money return control is carried out when a money return order signal RM is produced by a money return order signal delivery unit 59. The money payout control unit 48, upon receipt of the money return order signal RM, controls the coin and bill payout section 16 so that the section 16 will pay out money corresponding to the deposited amount K (or the balance thereof) calculated in the deposited amount calculation unit 12. Paying out of bills or coins is conducted one by one. The coin and bill payout section 16 supplies a payout confirmation signal to the control unit 48 each time the section 16 pays out one bill or coin of the denomination designated by the control unit 48. The control unit 48 subtracts the amount of the paid out bill or coin from the deposited amount K of the calculation unit 12 (or subtracting 1 in the deposited-number-by-denomination counter unit 11 corresponding to the particular denomination). Simultaneously, the payout confirmation signal $OS_{10-1000}$ corresponding to the paid out bill or coin is provided to the stored coin and bill number counter unit 15 and the contents of the counter unit 15 thereby are subtracted as was previously described.

In the above described manner, the deposited amount K (or balance thereof) decreases as the bills or coins are paid out and when it finally reaches a state K=0, the money payout control is completed. As in the above described collection control, there are various ways in the money payout control and the manner of subtraction in that control among which any suitable way may be selected. For example, bills and coins of the respective denominations may be paid out in accordance with the combination of numbers of the respective denominations held in the calculation unit 11, or the deposited amount K of the deposited amount counter unit 12 may be paid out by using bills or coins of as large denomination as possible, or values of the respective digits (R1000*i*, R100*i* and R10*i*) of the amount K (i.e., corresponding to the change Ri to be paid out) may be paid out by using bills and coins stored for change corresponding to the respective digits. No matter whether the payout is conducted by reason of paying out change, returning the whole deposited amount due to cancellation of purchasing or returning of money caused by other automatic money return control, the money payout control unit 48 carries out the above described money payout control operation in response to the money return order signal RM. In a case where the money return order signal RM is given during the collection control, the money payout control is performed after completion of the collection control.

The money collection and payout control unit 48 prohibits deposition of coins and bills by controlling a coin and bill rejection device (CREM) 60 when deposition of coins and bills should be refused. When the money deposition prohibition state is brought about by the coin and bill rejection device 60, deposited coins and bills are returned before they reach the deposited coin and bill detection unit 10 so that acceptance and counting of the coins and bills are not performed. There are various cases where the deposition should be refused, such as during the money payout control, stoppage of electric current, occurrence of malfunction, unsetting of the set vend price SPi and the inventory control in which cases acceptance of coins and bills would cause inconvenience. Further, even during the collection control as described above, deposition of coins and bills may be refused by operating the rejection device 60 if acceptance of the coins and bills is likely to cause inconvenience.

The signal $\overline{H}$ provided from the money collection and payout control unit 48 to the change payment permission judgement unit 18 normally is "1" but is turned to "0" when the control unit 48 is performing the collection control or the money payout control such as paying out of change and returning of money ro the money deposition rejection control. In the judgement unit 18, generation of the vend possible signal Vi is inhibited when the signal $\overline{H}$ is "0", i.e., when the control unit 48 is performing the above described control operations. More specifically, the AND gate 47 in FIG. 3 is disabled by the signal $\overline{H}$ and generation of the vend possible signal Vi therefore is prohibited despite satisfaction of the vend possible condition.

The money return order signal delivery unit 59 outputs the money return order signal RM through an OR gate 61 when change should be paid out, the deposited amount should be returned to the customer upon his demand or otherwise the money should be automatically returned. Firstly, generation of the money return order signal RM for paying out of change will be described. Time for paying out change differs depending upon whether the vending machine is a single vending type one or a continuous vending type one. In the present embodiment, the vending machine can be switched between the single vending type and the continuous vending type by operation of a single-continuous changeover switch 62. When the switch 62 is connected to a position as illustrated, the vending machine becomes the continuous vending type whereas when the switch 62 is connected to b position, the vending machine becomes the single vending type. If the vending machine is in the single vending mode in which the switch 62 is connected to the b position, a signal "1" is constantly provided from the switch 62 to an AND gate 63. The AND gate 63 receives, at another input thereof, the output of a single vend memory circuit 64. The single vend memory circuit 64 is reset initially (when the deposited amount K is 0) and stores "1" when it has received the vend possible signal VS. Accordingly, when the first vending has been made after deposition of money, the signal "1" is stored in the memory circuit 64 by the vend start signal VS which has been generated at the first vending. The storage of "1" in the memory circuit 64 enables the AND gate 63 and a signal "1" is supplied from the AND gate 63 to the OR gate 61. The money return order signal RM outputted from the OR gate 61 thereby is turned to "1". The money collection and payout control unit 48 stores the money return order signal RM and, after completion of the collection control (i.e., after disappearing of the vend start signal VS), performs the money payout control in accordance with the signal RM. Accordingly, a change payout mode is brought about upon subtracting the set vend price SPi of the first vended article from the deposited amount K and paying out of change is carried out. Upon completion of paying out of change and reducing of the contents of the deposited amount K to 0, the storage of the money return order signal RM and the storage in the first vending memory circuit 64 are reset. In the above described manner, change is automatically paid out upon a single vending in the case where the switch 62 is connected to the single vend position (b).

In the case of the continuous vending type, the singlecontinuous changeover switch 62 is connected to the a position as illustrated. In this case, a signal "0" is constantly supplied from the switch 62 to the AND gate 63 and the AND gate 63 thereby is disabled. Accordingly, change is not paid out unconditionally by a single vending as in the single vending mode. In the present embodiment, judgement of a timing for paying out change in the continuous vending mode, i.e., judgement as to whether continuous vending is possible or not, is performed in association with the vend possible judgement by the comparison and operation unit 14 and the change payment permission judgement unit 18, and change is automatically paid out when judgement has been made that vending is no longer possible by the present amount K of the deposited coins and bills. The output of the single vend memory circuit 64 is applied to an AND gate 65 and this AND gate 65 is enabled if at least a single vending has been made. A signal produced by inverting the output of the OR gate 56 by an inverter 66 is applied to a timer 67 and the output of the timer 67 in turn is applied to another input of the AND gate 65. The OR gate 56 outputs a signal "1" when any one of the vend possible signals Vl–Vn (or the article selection signals Sl–Sn) on the lines 52-1 through 52-n is "1". When all of the vend possible signals Vl–Vn (or the article selection signals Sl–Sn) on the lines 52-1 through 52-n have become "0", the output of the OR gate 56 is turned to "0" and the output of the inverter 66 is turned to "1". The timer 67 produces an output "1" when the input signal maintains "1" over a certain length of time (T1). This operation time T1 of the timer 67 is determined to a suitable length taking into account the time interval between vending operations in the continuous vending mode. More specifically, it is a proper time from a time point at which the vend possible signals Vl–Vn have once been cancelled by the vend start signal VS till a time point at which the vend possible signals Vl–Vn rise again for a subsequent vending. As was previously described, generation of the vend possible signal Vi is inhibited by the signal $\overline{H}$ while the control unit 48 performs the collection control in response to the vend start signal VS. Accordingly, the operation time T1 of the timer 67 may be set to a suitable length, for example, time length equivalent to or slightly longer than time required for the collection control with or without an additional time required for additional deposition of coins or bills.

When the first vending has been made, a signal "1" is stored in the single vend memory circuit 64 and the vend possible signals Vl–Vn in the memory circuits 51-1 through 51-n are reset. Since the article selection signals Sl–Sn are also cancelled after several hundred milliseconds, signals on the lines 52-1 through 52-n are all turned to "0" and the output of the inverter 66 thereupon rises to "1". The operation of the timer 67 thereby is started. During the operation time, the output of the timer 67 still is "0". The AND gate 65 therefore is not enabled and the money return order signal RM is not generated. The control unit 48 therefore carries out the collection control during this time, subtracting the vend price SPi of the first vended article from the deposited amount K. Then, the comparison of the present amount K of the deposited coins and bills with the respective set vend prices SPi and the change payout permission judgement are carried out by the comparison and operation unit 14 and the change payout permission judgement unit 18 (i.e., vend possible judgement as to a second vending is made) and the vend possible signal Vi ("1") corresponding to set vend prices SPi for vendible articles are stored in the memory circuits 51-1 through 51-n. Thus, when the result of the vend possible judgement for the next vending is obtained, the operation time T1 of the timer 67 has not finished yet. Accordingly, if even a single vend possible signal Vl–Vn has been generated (i.e., turned to "1"), the output of the inverter 66 falls to "0" thereby interrupting the operation time of the timer 67. The AND gate 65 therefore is still not enabled so that the continuous vending mode is maintained.

When the second vending has been made, the vend possible signals Vl–Vn are reset and the operation of the timer 67 is resumed. Upon subsequent rendering of judgement that a next vending is possible in the same manner as was previously described, the operation of the timer 67 is interrupted. Thus, the AND gate 65 is not enabled so long as vending is possible and change is not paid out. If judgement that none of the articles is vendible is made in the second and subsequent vend possible judgements, the operation time T1 of the timer 67 is terminated without generation of the vend possible signals Vl–Vn (i.e., the output of the inverter 66 maintaining "1"). A signal "1" thereupon is supplied from the timer 67 to the AND gate 65. The AND gate 65 is enabled now and a signal "1" is provided from the AND gate 65 to the OR gate 61. The money return order signal RM outputted from the OR gate 61 thereby is turned to "1" and the money collection and payout control unit 48 starts the change payout control operation.

It is a characteristic feature in the above described continuous vend possible judgement control that whether the continuous vending is possible or not (i.e., whether change should be automatically paid out or not) is judged in association with the vend possible judgement made in the comparison and operation unit 14 and the change payout permission judgement unit 18. Accordingly, even if there is a set vend price SPi which is smaller than the present amount K of the deposited coins and bills, judgement that the continuous vending is not possible is made if payout of change corresponding to the difference between the set vend price SPi and the present amount K is not possible and, in this case, change can be automatically paid out. Assume, for example, that a minimum amount of the set vend price SPi is 80 yen and there eixsts, in addition, a set vend price of 200 yen. Assume, further, that the 10-yen change coins are short (i.e., EP10 is "0" and RC10 is 1 or less) but that the 100-yen change coins are sufficient and a 500-yen coin has been deposited. Since there is only one or less 10-yen change coin, the vend possible signal Vi is not generated for "SPi=80" which requires at least two 10-yen coins as change whereas the vend possible signal Vi is generated for "SPi=200" for which change can be paid by 100-yen coins only. If an article of 200-yen has been vended twice continuously, the balance K of the deposited money is reduced to 100 yen so that the condition "K≧SPi" is no longer satisfied with respect to "SPi=200".

As for "SPi=80", the condition "K≧SPi" is satisfied but the difference of 20 yen cannot be paid out and, accordingly, the vend possible signal Vi is not generated as described above. Thus, the vend possible signal Vi is not generated at all when the balance K has been reduced to K=100 yen. As a result, the AND gate 65 is enabled and the balance (K=100 yen) is automatically paid out as change. If prohibition of the continuous vending was made when the balance K of the deposited money has been reduced below the minimum set vend price (80 yen) as in the prior art vending machine, the judgement that the continuous vending is possible would still be made when the balance K is K=100 yen. In such a case, the automatic payout of change could not be made whereas vending of an article would be prohibited by the change payout impossible judgement and the customer would not be able to obtain either the article or change (though it is of course possible to pay out change later by manually operating a money return demand switch). According to the present invention, such inconvenience will never take place.

If returning of the deposited amount K (or balance thereof) is desired, a money return demand switch 68 is operated. By turning on of the switch 68, a signal "1" is provided to the OR gate 61 and the money return order signal RM is turned to "1". The control unit 48 thereby implements the control of paying out coins or bills corresponding to the deposited amount (or balance) K.

Two examples of the automatic money return control other than the change payout control are shown in FIG. 1. One of the examples is a timer 69. To this timer 69 is applied the output of the OR gate 56. This timer 69 produces, as the timer 67, an output signal "1" when its input signal maintains "1" over a certain period of time (T2). The operation time T2 of the timer 69, however, is much longer than the operation time T1 of the timer 67. The operation time T2 in a normal operation is set to have a time length which is longer than duration of the vend possible signals Vl–Vn or the article selection signals Sl–Sn. In a normal operation, therefore, the output of the OR gate 56 falls to "0" before lapse of the operation time T2 of the timer 69 and the operation of the timer 69 thereby is interrupted, the output thereof being always "0". If, however, there occurs an abnormal situation in which the vend possible signals Vl–Vn or the article selection signals Sl–Sn continue to be produced, the operation time T2 finishes while the output of the OR gate 56 maintains "1" so that the signal "1" is provided to the OR gate 61 form the timer 69. This causes the OR gate 61 to supply the money return order signal RM to the control unit 48 with the result that the deposited money is automatically returned to the customer.

In a case where the vend start signal VS is provided despite absence of the vend possible signals Vl–Vn, an AND gate 70 is enabled and the money return order signal RM is produced through the OR gate 61. The AND gate 70 receives an output of a differentiation circuit 71 which differentiate a rise portion of the vend start signal VS and the output of the NOR gate 57. When there is no vend possible signals Vl–Vn on the lines 52-1 through 52-n at all, the output of the NOR gate 57 is "1". If, accordingly, the vend start signal VS is provided despite absence of the vend possible signals Vl–Vn, the AND gate 70 is enabled instantly at the rise portion of the vend start signal VS and the money return order signal RM is produced. The control unit 48 stores the signal RM and enters the money payout mode and also controls the rejection device 60 to bring about a coin and bill deposition rejection mode. If the vend start signal VS is produced in the normal operation, the vend possible signals Vl–Vn are reset. For preventing occurrence of inconvenience in this case, a suitable arrangement is made to prevent enabling of the AND gate 70, such as setting a suitable time delay so that the outputs of the memory circuits 51-1 through 51-n will fall to 0 after disappearance of the output pulse of the differentiation circuit 71. A circuit for achieving this purpose, however, is unrelated to the subject matter of the present invention and illustration thereof in FIG. 1 is omitted.

The OR gate 54 in the vend possible signal memory control unit 49 receives, at another input thereof, other suitable reset signal. For example, a signal H produced by inverting the signal $\overline{H}$ is applied to the OR gate 54 so that the memory circuits 51-1 through 51-n are reset when the vend possible judgement is prohibited by the "0" state of the signal $\overline{H}$. Alternatively, a zero signal $R_0$ produced by the calculation unit 12 when the deposited amount K is 0 is applied to the OR gate 54 so that the memory circuits 51-1 through 51-n are reset during the state K=0. As is well known, the signal $R_0$ representing K=0 is supplied to various memory circuits in the vending machine (excepting at least the calculation unit 15 and the memory unit 13) to reset storage in these memory circuits at the time of K=0, i.e., at the time of finishing of the vending operation or during the standby mode. Although illustration in FIG. 1 is omitted, the amount K (or balance thereof) calculated in the deposited amount calculation unit 12 is displayed in a money amount indicator.

In the embodiment shown in FIG. 1, the vend possible signals Vl–Vn and the article selection signals Sl–Sn are transmitted via the common lines 52-1 through 52-n. Transmission of these signals, however, may be made separately through different lines. In that case, the vend possible signals Vl–Vn are applied to the OR gate 56 and the NOR gate 57 and the article selection signals Sl–Sn are applied to the memory circuit 55. The timer 67 may be substituted by an arrangement in which the vend possible judgement for a next vending is made by utilizing a control signal provided by the control unit 48 or other circuit portion. Further, the comparison of the respective set vend price SPi and the deposited amount K may be made in two stages as described in the specification of the U.S. patent application Ser. No. 196073 or the British Patent Application laid open for public inspection under No. 2062924, i.e., comparison with all of the vend prices SPi in the first stage and comparison with a selected single price SPi in the second stage.

It will be understood that denominations which are counted in the stored coin and bill number counter unit 15 or those detected by the stored coin and bill shortage detection device 17, i.e., those of stored coins and bills used in the change payout permission judgement unit 18 are not limited to those used in the above described embodiment. If, for example, denominations used for paying out of change are 500-yen coins, 100-yen coins, 50-yen coins and 10-yen coins, a stored number counter and a shortage detection device for the 1000-yen bill are unnecessary. In the change payout permission judgement unit 18, all of the denominations of stored coins and bills need not be used for the change payout permission judgement but only denominations by which whether or not change can be paid out with respect to each of the digits of the change amount Ri can be judged need to be used. It is therefore possible to carry out the invention without taking into account the number of an intermediate denomination such as a 500-yen coin or a 50-yen coin in the change payout permission judgement. Further, as regards the largest denomination that can be used as the deposited coin or bill, there are cases where the change payout permission judgement need not particularly be made, such, for example, as a deposited coin or bill of the largest denomination is temporarily held in an escrow device and is paid out only when a coin or bill of that denomination needs to be paid out or deposited coins or bills of the largest denomination are automatically supplied to a storage device exclusively provided for the denomination and a coin or bill of the denomination is paid out from that exclusive storage device. In such cases, the deposited coin or bill exists when a coin or bill of that denomination must be paid out as change so that the coin or bill of the denomination can be paid out as change without fail. Accordingly, the change payout permission judgement is unnecessary as far as this largest denomination is concerned. If, accordingly, five denominations of coins and bills, e.g., 1000-yen, 500-yen, 100-yen, 50-yen and 10-yen are usable, an arrangement may be made so that the change payout permission judgement unit 18 will conduct the change payout permission judgement as to only the hundreds digit R100*i* and the tens digit R10*i* of the change amount Ri (i.e., difference). In this case, signals representing stored number RC100 or 100-yen coins and stored number RC10 of 10-yen coins and 100-yen coin shortage detection signal EP100 and 10-yen coin shortage detection signal E10 only may be used as signals representing numbers of the stored coins and bills payable as change. What we claim is:

1. A vend possible judgement device for a vending machine, comprising:

comparison means for comparing an amount of deposited coins and bills with at least one set vend price, and judging if vending is possible;

operation means for calculating the difference between said amount of deposited coins and bills and said set vend price, said difference being an amount to be paid out as change;

stored change counter means for establishing and maintaining a count of the numbers of coins and bills of each denomination stored for paying out as change; and change payout permission judgement means for affirmatively judging that said amount to be paid out as change, determined by said operation means, can be paid out when the numbers of stored coins and bills, established and maintained by said counter means are, by denominations or by combinations of denominations, sufficient to equal said amount to be paid out as change;

said vend possible judgement device rendering a judgement that vending is possible only if said comparison means has judged that vending is possible and said change payout permission judgement means has affirmatively judged that change can be paid out.

2. A vend possible judgement device as defined in claim 1, wherein said change payout permission judgement means first separates the amount to be paid out as change into its respective digits and then judges whether each of the respective digits can be paid out using coins and bills of denominations corresponding to said respective digits, said affirmative judgement resulting only if all of the respective digits can be paid out.

3. A vend possible judgement device as defined in claim 1, which further comprises:

shortage detection means for detecting, with respect to each of the denominations of coins and bills stored for paying out as change, whether there is a shortage in one or more of the denominations; and wherein said change payout permission judgement means provides an affirmative judgement either on the basis of sufficient numbers of the stored coins and bills of the respective denominations obtained by said counter means or on the basis of detection by said shortage detection means that none of the denominations required for payout has a shortage.

4. A vend possible judgement device as defined in claim 3, wherein said change payout permission judgement means comprises:

first means for judging, with respect to the respective digits of said amount to be paid out as change, if denominations corresponding to the digits are short as detected by said shortage detection means; and second means for judging, with respect to the respective digits of said amount to be paid out as change, whether values of the respective digits can be paid out based upon the numbers established by said counter means of denominations corresponding to the respective digits, or combinations of denominations equivalent thereto;

wherein an affirmative judgement results if, with respect to each of the digits of said amount to be paid out as change, at least one of the judgements by said first means and said second means indicates that the payout of change is possible.

5. A vend possible judgement device as defined in claim 4, wherein:

said comparison means compares the amount of deposited coins and bills with a plurality of said set vend prices;

said operation means calculating an amount to be paid out as change for each of said plurality of set vend prices; and said change payout permission judgement means judges whether each said amount to be paid out as change is payable by at least one of the judgements of said first means and said second means.

6. A vend possible judgement device as defined in claim 1, which further comprises:

a memory circuit, storing an indication that at least a single vending has been made;

first control means for reestablishing all possible vend possible judgements following each vending indicated by said memory circuit;

detection circuit means for detecting that, with respect to all of said set vend prices, said comparison means or said change payout permission judgement means, or both, provide a judgement result indicating that vending is not possible; and second control means for effecting control so as to automatically pay out the balance of said amount of deposited coins and bills as change in response to outputs of said memory circuit and said detection circuit means.

7. In a vend possible judgement device for a vending machine, including:

comparison means for judging whether vending is possible by comparing an amount of deposited coins and bills with a set vend price; and operation means for calculating a difference between said amount of deposited coins and bills and said set vend price;

the improvement comprising:

counter means for establishing the number of coins and bills of each of a plurality of denominations that presently are available for paying out as change; and change payout permission judgement means for judging whether said difference calculated by said operation means can be paid out or not by using the numbers of stored coins and bills for the respective denominations, or combinations thereof, established by said counter means.

8. A vend possible judgement device for a vending machine having a plurality of set vend prices, comprising:

comparison means for judging whether vending of each of differently priced articles is possible by comparing an amount of coins and bills deposited in said vending machine with each of said plurality of set vend prices;

operation means for calculating a difference between said amount of deposited coins and bills and each of said plurality of set vend prices;

stored coin and bill shortage detection means for establishing which denominations of coins and bills, among those stored for the purpose of dispensing change, have less than a predetermined number available;

counter means, associated with each denomination of coins and bills stored for the purpose of dispensing change, for counting the number of each denomination of coins and bills stored within a change storage unit; and change payout permission judgement means for determining whether or not said difference calculated by said operation means can be dispensed from said change storage unit based upon said stored coin and bill shortage detection means and for those denominations having less than said predetermined number available, upon said counter means.

9. A vend possible judgement device according to claim 8 having at least one article selection switch, and further comprising:

means for providing a vend enabling signal to said at least one article selection switch, for each of said differently priced articles, on condition that:

(a) said comparison means has judged that coins and bills have been deposited in a sum equal to or in excess of said set vend price; and (b) said change payout permission judgement means has determined that said difference calculated by said operation means is payable as change from said change storage unit.

10. A vend possible judgement device as in claim 8, wherein said change payout permission judgement means comprises decision means for determining if coins and bills stored in said change storage unit are sufficient to provide exact change based upon a decimal digit comparison of said difference calculated by said operations means with the numbers of coins and bills determined by said counter means, wherein said stored coins and bills may be combined among the several denominations to arrive at said determination.

11. For use in a vending machine of the type which initially confirms that a purchaser has deposited more money than the price of a selected article, and which determines the amount of change which must be returned to the purchaser, a vend possible judgement device comprising:

first means for determining if the available change of each denomination is above a threshold permitting a vend, and if so, for enabling the vend, stored change counter means for keeping a running count of the actual amount of available change of each denomination, and second means, cooperating with said counter means and operative if said first means determines that change in certain denominations is below threshold so that vending is prohibited by said first means, for determining if the correct change can be returned utilizing the actual amounts of change available, even though below threshold, and if so, for enabling the vend.

12. For use in a vending machine of the type which initially confirms that a purchaser has deposited more money than the price of a selected article, and which determines the amount of change which must be returned to the purchaser, a vend possible judgement device comprising:

first means for determining if the available change of each denomination is above a threshold permitting a vend, and if so, for providing a vend enabling signal, and second means, operative if said first means determines that change in certain denominations is below threshold so that vending is prohibited by said first means, for determining if the correct change can be returned utilizing the actual amounts of change available, even though below threshold, and if so, for providing a vend enabling signal, said vending machine only dispensing the selected article after occurrence of said vend enabling signal.

* * * * *